US006094547A

United States Patent [19]

Hart

[11] Patent Number: 6,094,547

[45] Date of Patent: Jul. 25, 2000

[54] PROCESS CONTROLLED CARRIER DISPENSING

[75] Inventor: Steven C. Hart, Ontario, N.Y.

[73] Assignee: Xerox Corporation, Stamford, Conn.

[21] Appl. No.: 09/363,616

[22] Filed: Jul. 30, 1999

[51] Int. Cl.[7] ..... G03G 15/00

[52] U.S. Cl. ..... 399/44; 399/58; 399/258

[58] Field of Search ..... 399/43, 44, 57, 399/58, 224, 259

[56] References Cited

U.S. PATENT DOCUMENTS

| | | | |
|---|---|---|---|
| 5,592,270 | 1/1997 | Takai et al. | 399/260 |
| 5,832,334 | 11/1998 | Corn et al. | 399/57 |
| 5,933,689 | 8/1999 | Kim | 399/233 |
| 5,937,246 | 8/1999 | Kaneyama | 399/328 |

*Primary Examiner*—Joan Pendegrass

*Attorney, Agent, or Firm*—Lloyd F. Bean, II

[57] ABSTRACT

An electrophotographic printing machine in which an electrostatic latent image recorded on an imaging surface is developed with toner particles to form a visible image thereof, including a hopper containing a supply of carrier material; a first developer unit for developing the electrostatic latent image with toner particles of a first color; a second developer unit for developing the electrostatic latent image with toner particles of a second color; conduit for connecting the first and second developer unit to the hopper so that carrier material flows to the first and second developer unit; a first feeding system, in communication with the conduit, for regulating the amount of carrier to the first developer unit; a second feeding system in communication with the conduit, for regulating the amount of carrier to the second developer unit, and a controller for controlling the regulation rate of the first and the second feeding system independently.

5 Claims, 3 Drawing Sheets

PROCESS CONTROLLED CARRIER DISPENSING

BACKGROUND OF THE PRESENT INVENTION

The invention relates generally to an electrophotographic printing machine and, more particularly, to a process control system for carrier dispensing in a color electrophotographic printing machine.

Generally, an electrophotographic printing machine includes a photoconductive member which is charged to a substantially uniform potential to sensitize the surface thereof. The charged portion of the photoconductive member is exposed to an optical light pattern representing the document being produced. This records an electrostatic latent image on the photoconductive member corresponding to the informational areas contained within the document. After the electrostatic latent image is formed on the photoconductive member, the image is developed by bringing a developer material into proximal contact therewith.

Typically, the developer material comprises toner particles adhering triboelectrically to magnetic carrier granules. This two component mixture is brought into contact with the photoconductive surface. The toner particles are attracted from the carrier granules to the latent image. The carrier granules are then returned to the developer housing where they can be re-supplied with toner particles and where the new toner particles can be prepared with the appropriate tribo-electric charge. It is clear that the developer material is a critical component of the printing machine. Developer material has several critical properties including its electrical conductivity and its ability to properly charge toner. As the developer material ages its critical properties change, and when the material approaches the end of its useful life, copy quality deteriorates. The rate at which the various critical properties of the developer material change is dependent on both variable and fixed (for a given design) factors. The variable factors include the area coverage of the image(s) being developed, the relative humidity within the developer housing, and the temperature of the developer material. The fixed factors include the volume of developer material within the housing, the amount of work done to the developer material in transporting it through the toner resupply process, the amount of work done to the developer material in presenting the developer material to the photoreceptor, and other factors.

It has been found that by continuously adding additional new carrier granules to the developer housing, the rate of change of the developer material critical properties can be significantly reduced or eliminated. As additional carrier granules are added to the chamber storing the developer material, an approximately equal volume of developer material must be removed therefrom to maintain the developer material therein at the desired quantity. This removal of material is typically achieved by use of an overflow port that maintains a constant volume of material within the chamber. Therefore, a carrier replenishment system must provide regulation of the input of carrier granules into the development unit.

Prior embodiments of carrier replenishment systems mixed a fixed ratio of carrier with the resupply toner. Thus as the toner is re-supplied to the developer housing to make up for the toner developed on to the latent image, new carrier granules are also introduced into the housing. This approach provides a significant improvement over the case of no developer material replenishment. With a fixed toner to carrier ratio, the carrier replenishment rate is directly linked to the individual user's printing/copying area coverage usage and can easily vary from machine to machine. Thus, the fixed toner to carrier ratio approach does not necessarily provide the optimal rate of material replenishment, nor can it optimally compensate for the developer material aging rate changes due to variable factors such as area coverage, humidity, and/or temperature.

The above problem is more acute in a color system employing several developer units where small variations in the developability of an individual color become readily apparent as significant hue shifts in the final out output. It has been found that aging rate of developer material in each developer unit is different for each color, and that each color material has different sensitivities to the variable factors such as area coverage.

SUMMARY OF THE INVENTION

One objective of the present invention is to provide a significant improvement in the carrier replenisher process is to utilize a carrier dispenser hopper separate from the toner supply, and to control the rate of material replenishment to each development unit based on: the machine's history of area coverage for that particular developer system, and/or the ambient temperature, and/or relative humidity.

The present invention obviates the problems noted above by utilizing an electrophotographic printing machine in which an electrostatic latent image recorded on an imaging surface is developed with toner particles to form a visible image thereof, including a hopper containing a supply of carrier material; a first developer unit for developing the electrostatic latent image with toner particles of a first color; a second developer unit for developing the electrostatic latent image with toner particles of a second color; conduit for connecting the first and second developer unit to the hopper so that carrier material flows to the first and second developer unit; a first feeding system, in communication with the conduit, for regulating the amount of carrier to the first developer unit; a second feeding system in communication with the conduit, for regulating the amount of carrier to the second developer unit, and a controller for controlling the regulation rate of the first and the second feeding system independently.

The is also provided a method for regulating carrier material to a plurality of developer units in a color printing machine, including the steps of: providing a source of carrier material in a hopper; connecting each of said plurality of developer units to said hopper so that carrier material flows to each of said plurality of developer units; regulating the amount of carrier to each of said plurality of developer units, regulating step includes controlling the regulation rate of each of said plurality of developer units independently from each other.

DESCRIPTION OF THE INVENTION

Figure 1:
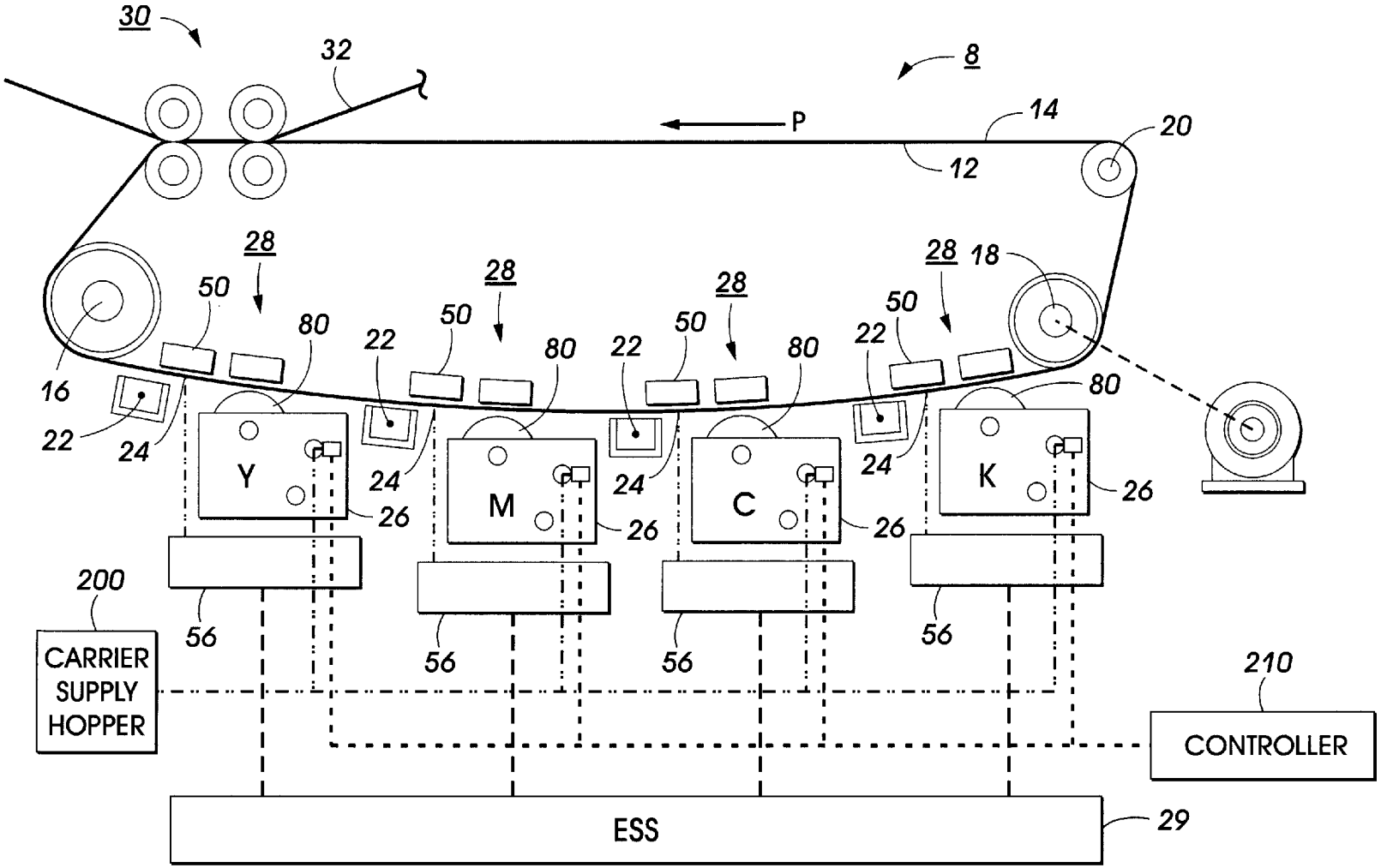
FIG. 1 is a side view, in section, of a four color xerographic reproduction machine incorporating the non-interactive magnetic brush developer of the present invention.

Referring to FIG. 1 of the drawings, there is shown a xerographic type reproduction machine 8 incorporating an embodiment of the non-interactive agitated magnetic brush of the present invention, designated generally by the numeral 80. Machine 8 has a suitable frame (not shown) on which the machine xerographic components are operatively supported. As will be familiar to those skilled in the art, the machine xerographic components include a recording member, shown here in the form of a rotatable photoreceptor 12. In the exemplary arrangement shown, photoreceptor 12 comprises a belt having a photoconductive surface 14. The belt is driven by means of a motorized linkage along a path defined by rollers 16, 18 and 20, and those of transfer assembly 30, the direction of movement being counterclockwise as viewed in FIG. 1 and indicated by the arrow marked P. Operatively disposed about the periphery of photoreceptor 12 are charge corotrons 22 for placing a uniform charge on the photoconductive surface 14 of photoreceptor 12; exposure stations 24 where the uniformly charged photoconductive surface 14 constrained by positioning shoes 50 is exposed in patterns representing the various color separations of the document being generated; development stations 28 where the latent electrostatic image created on photoconductive surface 14 is developed by toners of the appropriate color; and transfer and detack corotrons (not shown) for assisting transfer of the developed image to a suitable copy substrate material such as a copy sheet 32 brought forward in timed relation with the developed image on photoconductive surface 14 at image transfer station 30. In preparation for the next imaging cycle, unwanted residual toner is removed from the belt surface at a cleaning station (not shown).

Following transfer, the sheet 32 is carried forward to a fusing station (not shown) where the toner image is fixed by pressure or thermal fusing methods familiar to those practicing the electrophotographic art. After fusing, the copy sheet 32 is discharged to an output tray.

At each exposure station 24, photoreceptor 12 is guided over a positioning shoe 50 so that the photoconductive surface 14 is constrained to coincide with the plane of optimum exposure. A controller or electronic subsystem (ESS), indicated generally by reference numeral 29, receives the image signals representing the desired output image and processes these signals to convert them to a continuous tone or gray-scale rendition of the image which is transmitted to a modulated output generator, for example the ROS, indicated generally by reference numeral 12. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS. (ROS) that creates an image in a series of horizontal scan lines having a certain number of pixels per inch. It may include a laser with rotating polygon mirror blocks and a suitable modulator, or in lieu thereof, a light emitting diode array (LED) write bar. At each exposure station 24, a ROS 56 exposes the charged photoconductive surface 14 point by point to generate the latent electrostatic image associated with the color separation to be generated. It will be understood by those familiar with the art that alternative exposure systems for generating the latent electrostatic images, such as print bars based on liquid crystal light feeding systems and light emitting diodes (LEDs), and other equivalent optical arrangements could be used in place of the ROS systems such that the charged surface may be imagewise discharged to form a latent image of the appropriate color separation at each exposure station.

Continuing with the description of operation at each developing station 24, a magnetic brush transport member 80 is disposed in predetermined operative relation to the photoconductive surface 14 of photoreceptor 12, the length of transport member 80 being equal to or slightly greater than the width of photoconductive surface 14, with the functional axis of transport member 80 parallel to the photoconductive surface and oriented at a right angle with respect to the path of photoreceptor 12. Advancement of transport member 80 carries the developer blanket into the development zone in proximal relation with the photoconductive surface 14 of photoreceptor 12 to develop the latent electrostatic image therein.

The various machine functions are regulated by ESS 29. The ESS is preferably a programmable microprocessor which controls all of the machine functions described hereinbefore. The ESS provides a comparison count of the copy sheets, the number of documents being recirculated, the number of copy sheets selected by an operator, time delays, jam corrections, and etc. The control of all the exemplary systems heretofore described may be accomplished by conventional control switch inputs from the printing machine console, as selected by the operator. Conventional sheet path sensors or switches may be utilized to keep track of the position of the original documents and the copy sheets.

Figure 2:
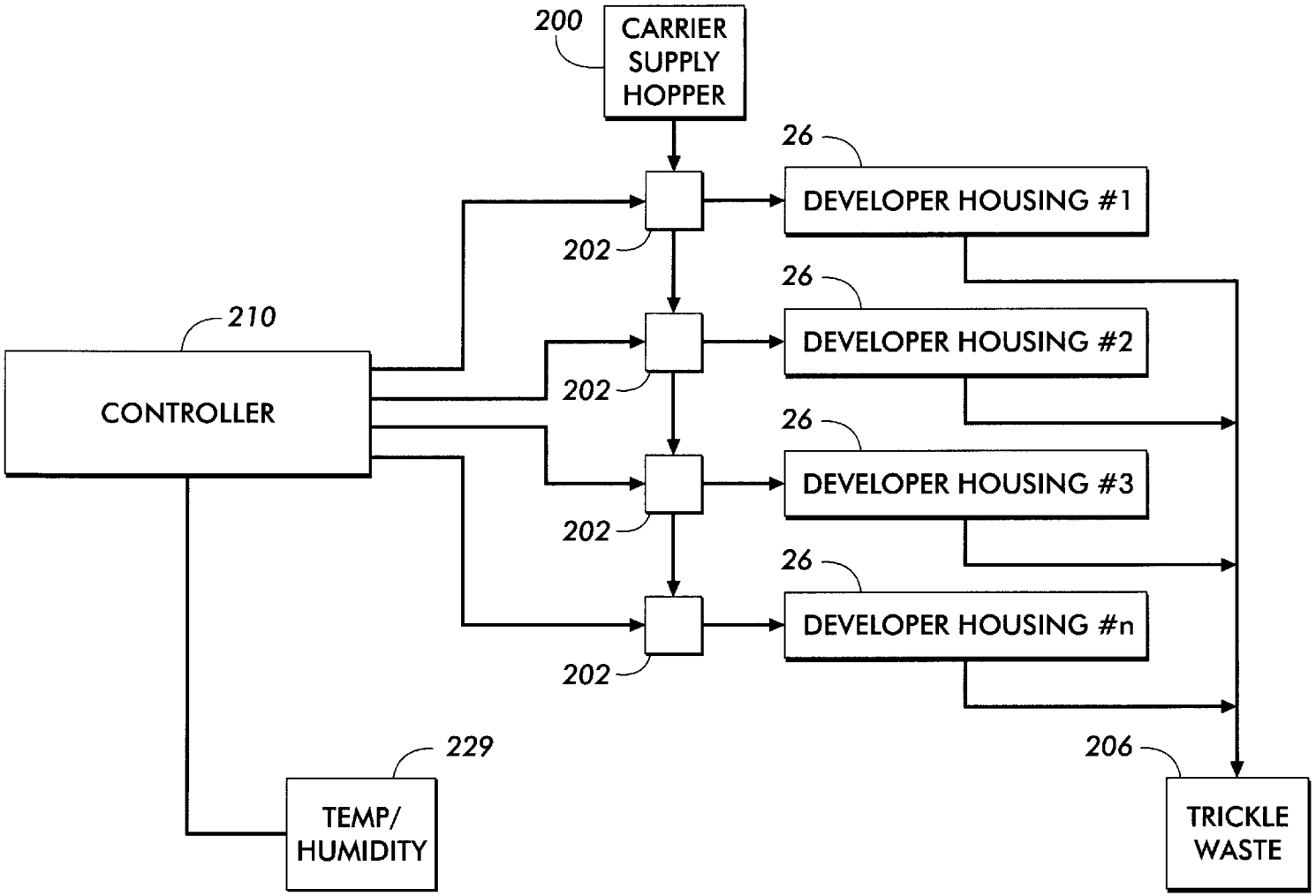
FIG. 2 is a process diagram of the present invention.
Figure 3:
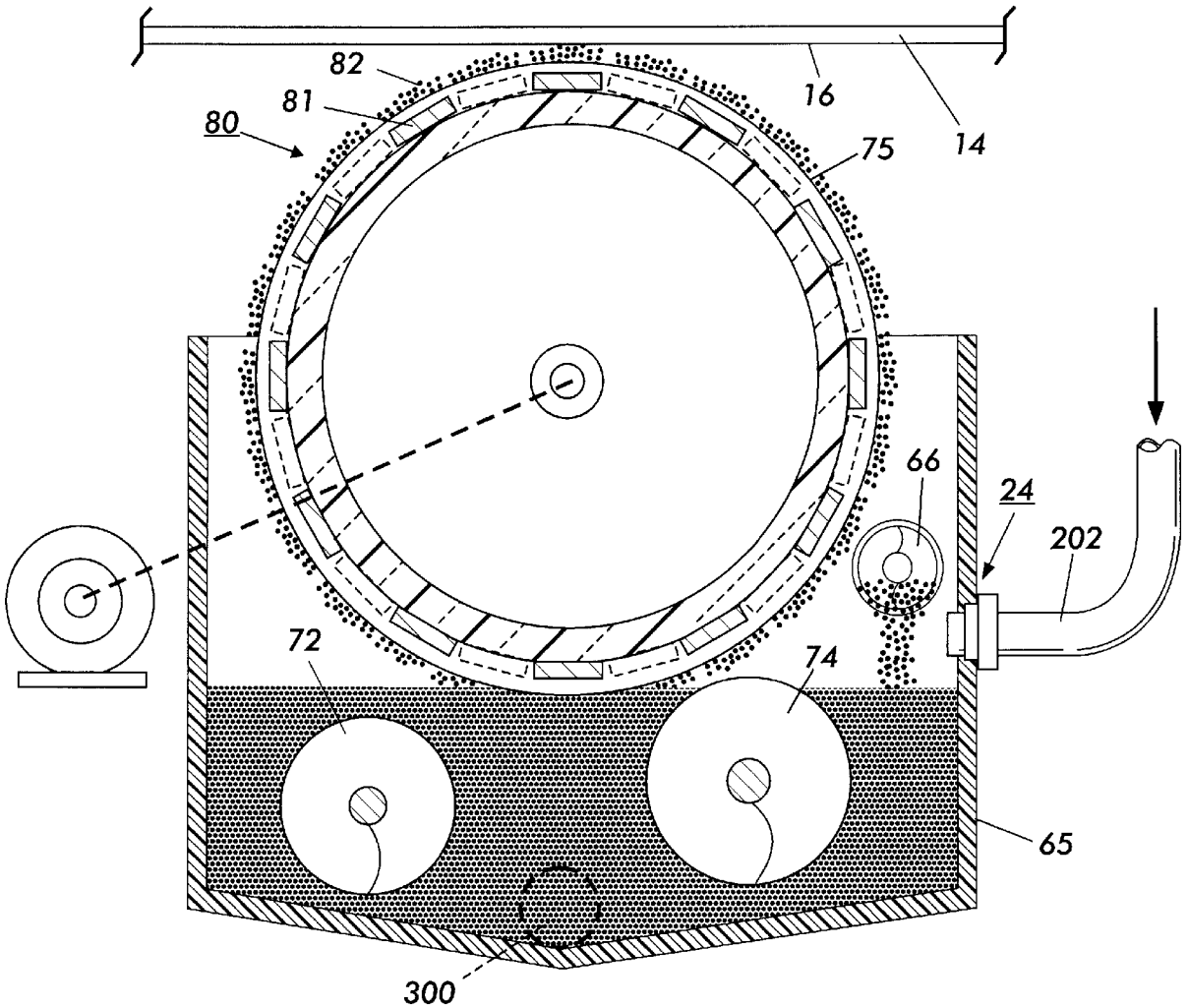
FIG. 3 is a schematic of a developer unit employed with the present invention.

Further details of the construction and operation of the present invention is provided below referring to FIGS. 2 and 3. The present invention utilizes a trickle type developer system wherein it is desired to add a constant flow of new carrier material into the developer material while maintaining a constant flow of old developer material out of the housing.

Developing station 24, a magnetic brush developer roll 80 is disposed in predetermined operative relation to the photoconductive surface 16 of photoreceptor 14, the length of developing roll 80 being equal to or slightly greater than the width of photoconductive surface 16, with the axis of roll 80 parallel to the axis of photoreceptor 14. Developer roll 80 has a plurality of stationary magnet assemblies 81 disposed within a rotatable cylinder or sleeve 75, sleeve 75 being rotatably journaled for rotation in the opposing sides of developer housing 65. Magnet assemblies 81 are arranged so that as sleeve 75 rotates, developer is attracted to the exterior surface of sleeve 75 to form a brush-like layer 82 on sleeve 75. Rotation of sleeve 75 carries the developer brush 82 into developing relation with the photoconductive surface 16 of photoreceptor 14 to develop the latent electrostatic image therein.

As latent images are formed, and developer and toner depleted, fresh toner is dispensed as dispenser cartridge 66 rotates. Auger 72 continually mixes the fresh toner with the denuded carrier particles. As the auger 72 rotates in a counterclockwise direction, and with arcuate segments the mixture is conveyed. The mixture then transfers into the auger 74, which carries the developer uphill to the retransfer point. The system is thus constantly ensuring that freshly added toner is constantly being mixed into the existing developer.

Trickle port 300 is located between two augers on the end of a developer housing in order to maintain a constant trickle flow out of the housing and maintain the required developer sump level. This system dumps the developer material (trickle waste) into one common easy to replace bottle 206.

The present invention utilizes a single hopper 200, although a separate carrier hopper for each color could be utilized for multiple development subsystems. A single hopper has an advantage in that carrier can be readily added to a single hopper reducing maintenance requirements. Carrier is supplied to each developer housing 26 via feeding system 202 which can take the form of a controlled auger, an auger and a controlled valve, or only a controlled valve. Depending on the specific design of the electrographic printing machine, it may be advantageous to have both an auger and a controllable valve. At the least, a controllable auger or a controllable valve is required. Each developer housing 26 has feed system 202 which regulates the amount of carrier enter the developer housing. A controller 210 regulates the operation of each controlled feed system 202 independently.

The controller for a specific developer housing receives information from the electronic subsystem (ESS) as to the area coverage for each color separates which correlates number of pixels for each separation of each document printed. Using this data, a weighted average representation the recent area coverage history is computed, additionally, the controller may receive information from temperature, and/or relative humidity sensors 229 located within the printing machine. The weighted average is important, because it has been found that the rate at which the developer material properties change is very dependent on the rate of toner throughput through the developer housing. The appropriate carrier replenishment rated values for various area coverage, humidity, and temperature conditions are put in a lookup table. Values of replenishment rates can be determined by separate experiments (in which optimum values are determined by trial and error as a function of changing area coverage per number of prints, changing values temperatures and changing values humidity) these appropriate values are programmed into the controller. At this point the controller can determine the desired replenishment rate, say in grams of carrier to be dispensed per hundred prints. Using this information, and previously obtained calibration data for the grams of carrier dispensed from the hopper per second, the controller can determine the appropriate activation interval per hundred prints and subsequently activate the control element 202 as required.

While the invention has been described with reference to the structures disclosed, it is not confined to the specific details set forth, but is intended to cover such modifications or changes as may come within the scope of the following claims:

What is claimed is:

1. An electrophotographic printing machine in which an electrostatic latent image recorded on an imaging surface is developed with toner particles to form a visible image thereof, comprising:

a hopper containing a supply of carrier material;

a first developer unit for developing the electrostatic latent image with toner particles of a first color;

a second developer unit for developing the electrostatic latent image with toner particles of a second color;

means for connecting said first and second developer unit to said hopper so that carrier material flows to said first and second developer unit;

a first feeding system, in communication with said connecting means, for regulating the amount of carrier to said first developer unit;

a second feeding system in communication with said connecting means for regulating the amount of carrier to said second developer unit;

a controller for controlling the regulation rate of said first and said second feeding system independently; and a temperature sensor and humidity sensor, said temperature sensor and humidity sensor being in communication with said controller, for sending data associated in determining said predefined regulation rate.

2. The printing machine of claim 1, wherein said controller includes:

means for computing weighted average coverage to be developed by each of said first developer unit and said second developer unit; and means for determining a regulation rate based upon weighted average coverage, temperature and humidity.

3. The printing machine of claim 2, wherein said computing means comprises means for counting pixels to be developed by said first developer unit, means for counting pixels to be developed by said second developer unit, and means for counting number of prints to be developed.

4. A method for regulating carrier material to a plurality of developer units in a color printing machine, comprising the steps of:

providing a source of carrier material in a hopper;

connecting each of said plurality of developer units to said hopper so that carrier material flows to each of said plurality of developer units;

regulating the amount of carrier to each of said plurality of developer units, regulating step includes controlling the regulation rate of each of said plurality of developer units independently from each other said regulating step further includes the steps of:

computing weighted average coverage to be developed by each of said plurality of developer units;

sensing temperature and humidity in said printing machine; and determining a regulation rate based upon weighted average coverage, temperature and humidity.

5. The method of claim 4, wherein said computing step includes the steps of: counting pixels to be developed by each of said plurality of developer units, and counting number of prints to be developed.

* * * * *